US006435111B1

(12) United States Patent
Stumpf

(10) Patent No.: US 6,435,111 B1
(45) Date of Patent: Aug. 20, 2002

(54) COUNTERBALANCE TABLE

(75) Inventor: William Stumpf, Kitchener (CA)

(73) Assignee: CompX International Inc., Kitchener (CA)

( * ) Notice: Subject to any disclaimer, the term of this patent is extended or adjusted under 35 U.S.C. 154(b) by 0 days.

(21) Appl. No.: 09/722,768

(22) Filed: Nov. 27, 2000

Related U.S. Application Data

(60) Provisional application No. 60/204,199, filed on May 15, 2000.

(51) Int. Cl.[7] ..... A47B 9/00
(52) U.S. Cl. ..... 108/147
(58) Field of Search ..... 108/6, 7, 144.11, 108/146, 147, 147.19; 248/188.5

(56) References Cited

U.S. PATENT DOCUMENTS

| | | | | |
|---|---|---|---|---|
| 1,590,296 A | | 6/1926 | Klein et al. | |
| 3,570,800 A | | 3/1971 | Cycowicz | |
| 4,156,391 A | * | 5/1979 | Ubezio | 108/144.11 |
| 4,381,714 A | * | 5/1983 | Hennebert et al. | 108/147 |
| 5,078,351 A | | 1/1992 | Gualtieri | |
| 5,313,892 A | * | 5/1994 | Tice | 108/147 |
| 5,322,025 A | * | 6/1994 | Sherman et al. | 108/147 |
| 5,433,409 A | | 7/1995 | Knopp | |
| 5,438,939 A | * | 8/1995 | Clarke | 248/188.5 X |
| 5,540,160 A | * | 7/1996 | Rea | 108/147 X |

FOREIGN PATENT DOCUMENTS

| | | |
|---|---|---|
| DE | 1801159 | 4/1970 |
| DE | 40 40 286 | 6/1992 |
| FR | 2691889 | 12/1993 |
| NL | 8800880 | 11/1989 |

* cited by examiner

*Primary Examiner*—Janet M. Wilkens
(74) *Attorney, Agent, or Firm*—Banner & Witcoff, Ltd.

(57) ABSTRACT

A counterbalance table includes telescoping members for supporting the table. The telescoping members are augmented by gas cylinders which may be locked to preclude engagement with the table or unlocked so as to engage the table and facilitate supporting the table and a load thereon.

19 Claims, 4 Drawing Sheets

COUNTERBALANCE TABLE

CROSS REFERENCE TO RELATED APPLICATION

This is a utility application based upon a previously tiled provisional application. Ser. No. 60,204,199 filed May 15, 2000 for which priority is claimed.

BACKGROUND OF THE INVENTION

In a principal aspect, the present invention relates to a counterbalance table, and more particularly, to a work table construction having an adjustable counterbalance force for an adjustable height work table platform.

In the manufacturing sector, manufacture of various products often requires assembly of components or a product at a work station on a work table. The assembly of a product is effected by artisans or workers at that work table station. Because of the different physical characteristics of individual workers as well as because of the need to adjust the height of the work table as a product is being assembled thereon, work tables are constructed so that their height can be easily changed. A feature associated with such work tables is the requirement to be counterbalanced so that varying weights or loads on the table can be easily supported at a work station and the work table platform can be easily moved upwardly or downwardly as necessitated. Thus, various mechanisms have been developed to enable work station tables to be counterbalanced to accommodate the load of work pieces thereon and to simultaneously permit adjustment of the height of the table.

Previously, very complicated articulated arms and gear mechanisms have been used to provide a counterbalancing construction for work tables. Such counterbalance systems require numerous parts which are formed in complicated operations and interact or fit together in a manner which requires rigid tolerances in the manufacturing operation. Thus, there has developed a need to provide an improved counterbalance table construction.

SUMMARY OF THE INVENTION

Briefly, the present invention comprises a counterbalance table of the type having a work table platform which is mounted on a stand having a fixed vertical leg with a telescoping leg projecting therefrom with the telescoping leg connected from the fixed leg to the underside of the work table or work platform. In practice, first and second spaced parallel leg systems support the opposite sides of a work table. The telescoping leg includes a rack thereon. A pinion is typically attached to the fixed leg. The pinion engages the rack and the pinions of the respective legs are attached so that the legs will move smoothly in unison even though they are spaced one from the other. A foot pedal actuated locking mechanism is provided to lock the pinions and thus lock the table at a fixed height, depending upon the telescopic extension of the telescoping legs within the fixed legs of the table support stand.

Four fluid actuated cylinders are provided to further support the work platform or work table. Two cylinders are provided in association with each of the vertical upstanding leg systems. One of the fluid cylinders may remain constantly engaged with the work table to provide a counterbalance force to support the weight of the table itself. Thus, the one fluid cylinder includes either a gas or liquid which is compressed and provides a counterbalance force to support the work platform or table. The remaining three fluid cylinders are optionally engaged with the underside of the work platform or work table. That is, a locking mechanism is provided which locks and retains the additional fluid cylinders in the locked position unless appropriately released. The additional cylinders may be of varying capacity to support a load on the work table. For example, from 30 pounds up to 200 pounds of carrying capacity may be provided by each cylinder. The lock mechanism is activated or deactivated only when the work table is in the lowered position to permit disengagement of a locking plate from the support cylinders. When the table is in the lowered position then, the cylinders may be retained in their locked position so as not to engage the table and provide a counterbalance force to the underside of the work platform or they may also be transferred to the unlocked position so as to engage the underside of the work platform table and thus provide a counterbalance force to a load on the table. Since there are three cylinders in the disclosed embodiment in addition to the cylinder which provides the normal counterbalance force for the work table itself, the choice of which of the three cylinders may be activated depends upon the counterbalance force required. A worker can thus accommodate very precisely, the counterbalance force required at the work station. One, two, or three cylinders may be activated to counterbalance a force due to the weight on the work table.

The system is designed so that the cylinders can be released or unlocked for counterbalancing only when the table is in its lowest position. Once the table moves upwardly from its lowest position, a cam mechanism locks the cylinders in their locked or unlocked position, thereby disabling the cylinders or enabling the cylinders. Once the counterbalance force is set, however, for a fixed load, the table can be easily moved up and down as needed by the worker. Also, the table can be easily locked and unlocked in various positions when loaded by locking the pinion or releasing the pinion.

Thus, it is an object of the invention to provide an improved counterbalance table.

It is a further object of the invention to provide a counterbalance table which permits adjustment of the force on the table in an easy and inexpensive manner and which is highly efficient, to counterbalance the weight of the table and the load thereon.

Yet a further object of the invention is to provide a counterbalance mechanism which is easy to assemble, easy to service, inexpensive and rugged.

Another object of the invention is to provide a counterbalance table which permits adjustment of the counterbalance force in order to accommodate various loads.

Another object of the invention is to provide a counterbalance table which includes a locking mechanism that locks the counterbalance table height at a fixed height, depending upon worker preference and wherein that locking mechanism is a mechanical mechanism.

Yet a further object of the invention is to provide a counterbalance mechanism which permits symmetrical arrangement of counterbalance forces on a work table or platform.

These and other objects, advantages and features of the invention will be set forth in the detailed description which follow.

BRIEF DESCRIPTION OF THE DRAWING

In the detailed description which follows reference will be made to the drawing comprised of the following figures.

DESCRIPTION OF THE PREFERRED EMBODIMENT

Figure 1:
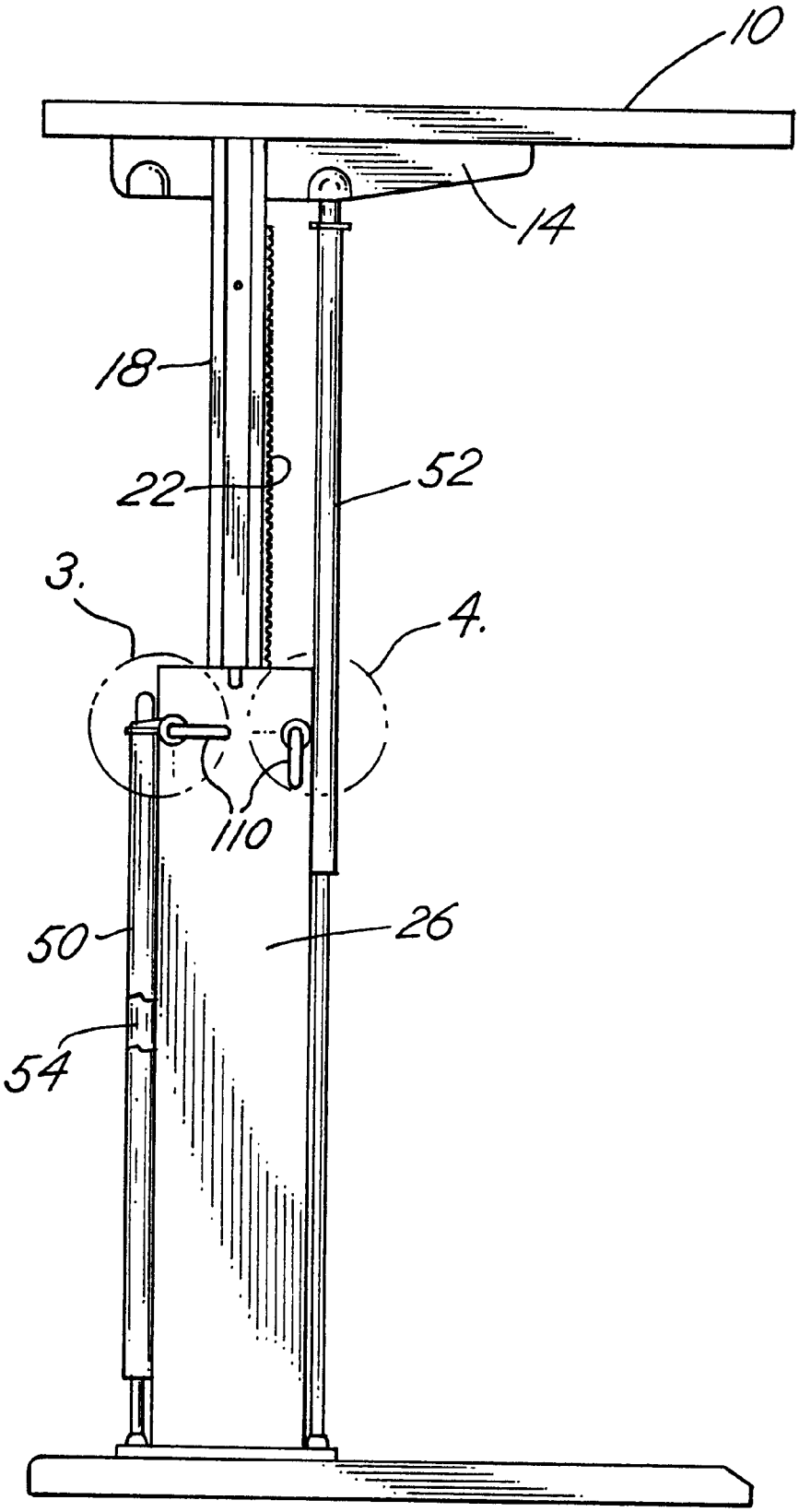
FIG. 1 is a side elevation of the counterbalance table of the invention.
Figure 2:
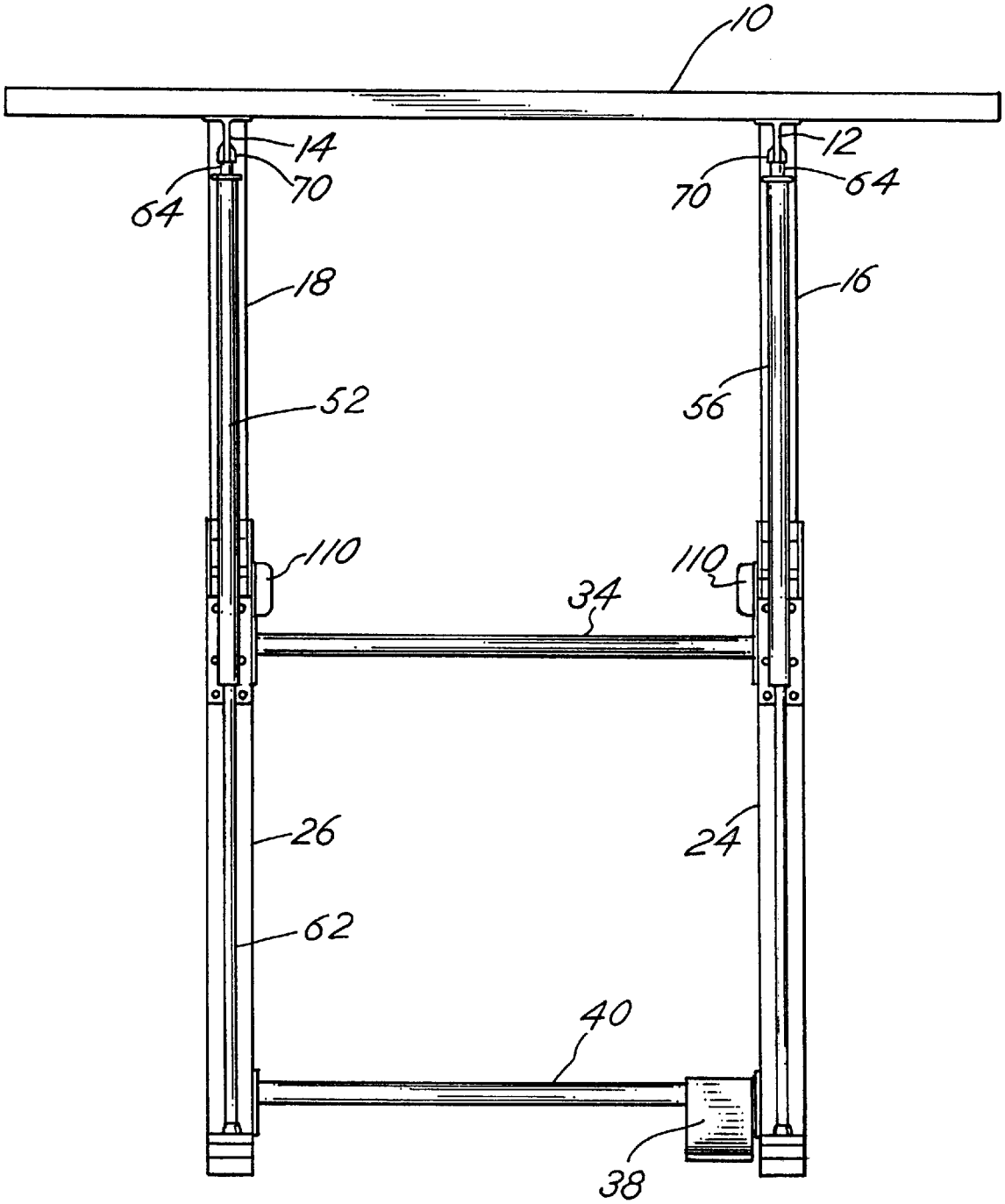
FIG. 2 is a front elevation of the counterbalance table of FIG. 1.

The counterbalance table includes a table platform or work table 10 which is generally a horizontal, planar platform, rectangular in shape and designed to receive work pieces for assembly. The table 10 is mounted on cross brackets 12 and 14 which are generally parallel to each other and spaced one from the other and from the lateral side edges of the table 10. The brackets 12 and 14 connect to first and second telescoping support members 16 and 18 respectively. Each support member 16 and 18 includes a rack 20 and 22 respectively. Each telescoping member 16 and 18 is telescopically and slidably engaged with a vertical support upright member 24 and 26 respectively. Telescopic members 16 and 18 thus slidably engage and move vertically upwardly and downwardly with respect to the fixed upright members 24 and 26. The fixed upright members 24 and 26 are mounted on a floor stand 28.

Each rack 20 and 22 engages with a separate pinion, for example, pinion 32 mounted at the opposite ends of a rod 34 extending between the fixed members 24 and 26. Rod 34 is journaled in the upright members 24 and 26 and the pinions 32 engage with racks 20 and 22 so that the telescopic members 16 and 18 will move uniformly upwardly and downwardly. The racks 20, 22 thus engage the pinions 32 and rotate the journaled shaft or rod 34 as members 16, 18 move.

A foot pedal 38 mounted on a pivotal rod 40 journaled in the upright fixed stands 24 and 26 includes a lever arm 42 which engages with a locking cam 44 to lock against one pinion 32 to preclude telescopic movement of telescoping members 16 and 18 when desired. Pivoting of the foot pedal 38 releases the locking cam 44, permitting upward and downward movement of the telescopic members 16 and 18 and thus table 10.

First, second, third and fourth gas cylinders 50, 52, 54 and 56 are arranged in pairs on opposite sides of the vertical fixed support members 24 and 26. Each cylinder, for example, cylinder 50 includes a cylinder section 60 and a rod 62. An upper drive head 64 is attached to the upper end of the cylinder section 60. Typically, the fluid cylinder 50 comprise a gas type shock absorber having a rating of 30 to 300 pounds, for example. Each of the cylinders 50, 52, 54 and 56 have their own rating. That is they may comprise gas, shock absorbers having a rating, for example, of from 30, 50, 80 and 110 pounds. The ratings may all be the same or they may be some desired combination depending upon the ultimate range of loads and likely loads to be placed upon the top of the table platform 10. The cylinder 50 typically remains permanently engaged with the underside of the table 10 to counterbalance the weight of table 10. It may optionally be designed to be disengaged from the underside of the table 10 in the manner of the lock control mechanism described for the other three cylinders 52, 54 and 56.

Figure 3:
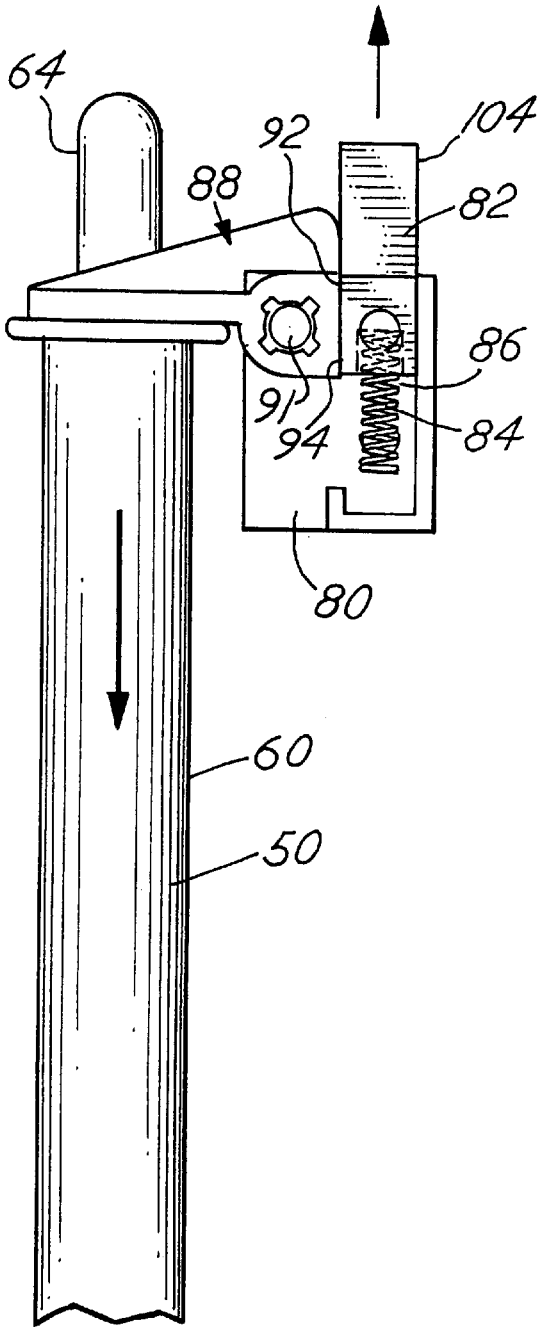
FIG. 3 is an enlarged elevation of the locking mechanism associated with the cylinders in the counterbalance table of FIG. 1.
Figure 4:
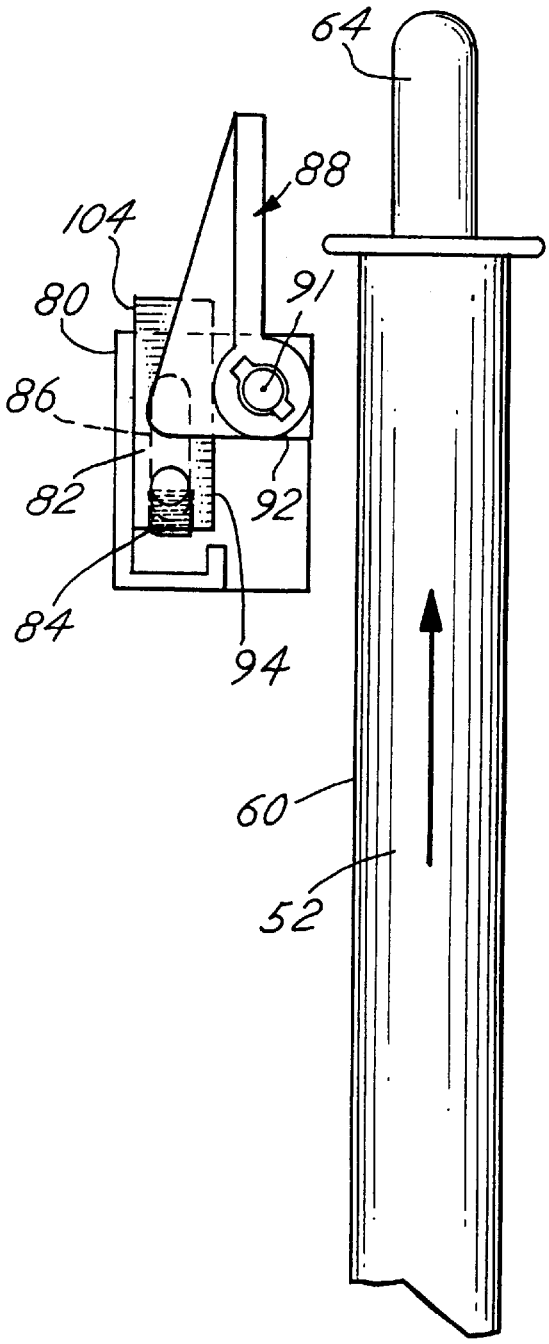
FIG. 4 is a further enlarged side elevation of the counterbalance mechanism associated with the counterbalance table of FIG. 1.
Figure 5:
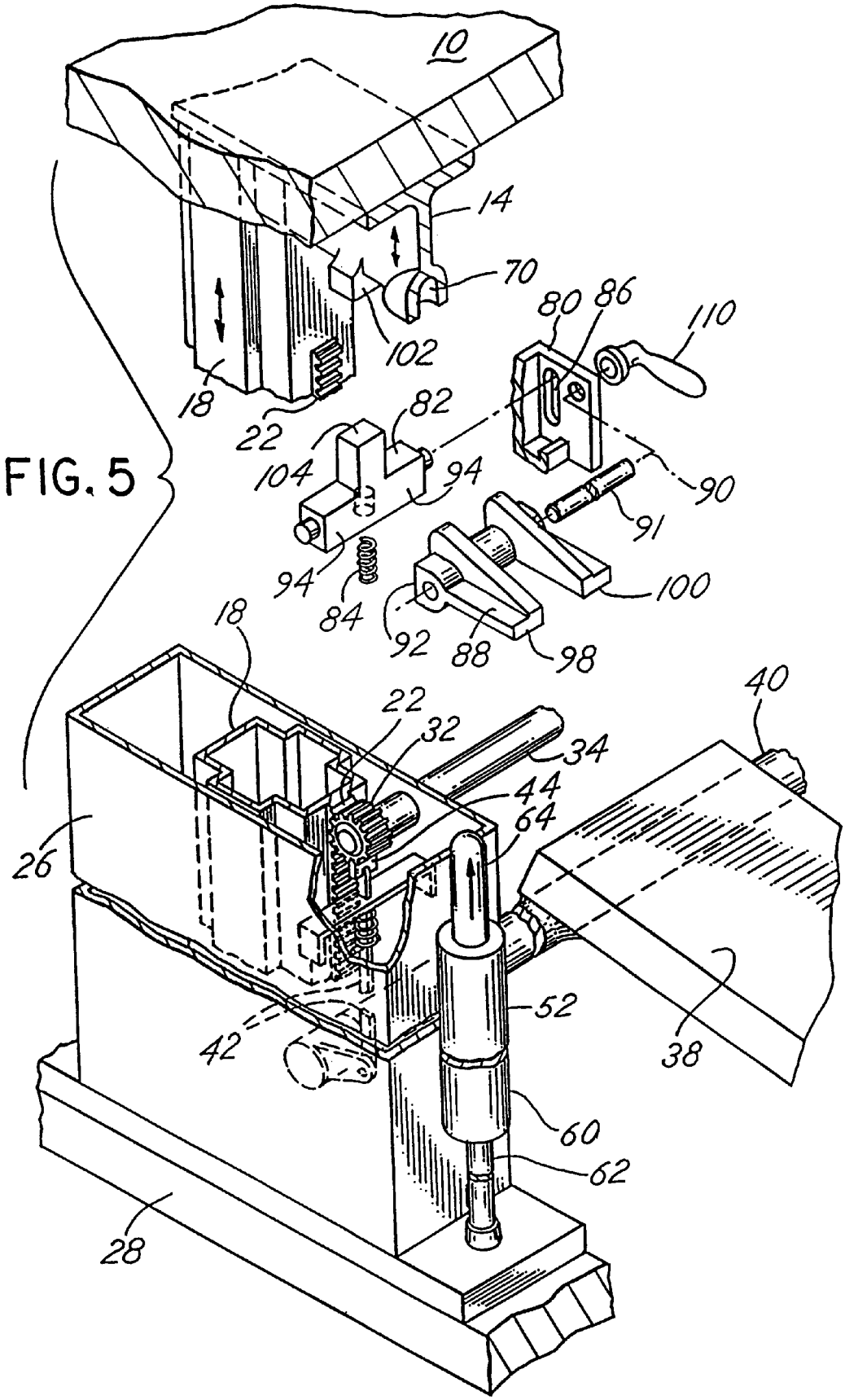
FIG. 5 is an exploded isometric view of the locking mechanism depicted in FIGS. 3 and 4.

A mechanism is provided in association with each of the cylinders 52, 54 and 56 as well as optionally in association with cylinder 50 to lock the cylinders in the lowered position such a shown in FIG. 1 or to release the cylinders individually so as to be engaged with the underside of the platform or table 10, and more particularly, with pockets, such as pockets 70 in the brackets 12 and 14 on the underside of the platform or table 10. The following description therefore relates specifically to the mechanism for locking or unlocking the engagement of the cylinders 52, 54 and 56 from the underside of the platform or table 10 and thus provide additional force against the underside of the table 10 to support a load thereon. FIGS. 3, 4 and 5 depict, with greater detail, this construction.

The locking mechanism for each of the cylinders is mounted on the vertical upstanding fixed upright members 24 and/or 26 and each locking mechanism is substantially identical. Thus, the description for one of the locking mechanisms is applicable to each of the other locking mechanisms. Each of the locking mechanisms is included and matched with each one of the cylinders 52, 54 and 56.

The upright member 24 includes parallel brackets 80 which retain a sliding biased locking follower member 82 biased by a spring 84 upwardly in slots 86 in the brackets 80. A separate locking yoke 88 is pivotally mounted in the brackets 80 on shaft 91 having an axis 90. The locking yoke 88 includes a flat cam surface 92 which is engaged by the cam follower surface 94 of the follower member or actuator 82 when the actuator 82 is in the vertically upper position biased by the spring 84 in the slots 86. Thus the follower surface 94 will engage the cam surface 92 and lock the yoke 88 in a fixed horizontal position. When in the fixed horizontal position, the yoke 88, which includes bifurcated arms 98 and 100, fit around the projection drive head 64 of the cylinder 52 holding the cylinder 52 downward so that it will not expand upwardly on the rod 60 and will not impart any force upon the table 10.

To release the yoke 88, the table 10 must be fully lowered so that a projection 102 on the underside of bracket 12 engages the upward projection 104 of the actuator 82. Upon such engagement, when the table 10 is fully lowered, the actuator 82 is moved in the slots 86 counter to the biasing of the spring 84 to disengage the cam follower 94 from the cam 92. This permits the yoke 88 to be rotated by means of a handle 110 attached to follower 88. When the yoke 88 is rotated vertically, for example, as depicted in FIG. 4, then the cylinder 56 is engaged against the underside of the table 10. That is, the projection head 64 fits within the pocket 70 and engages against the underside of the table 10.

Each of the cylinders 52, 54 and 56 have a similar lock and release mechanism. Thus, in order to release a yoke 88 associated with each of the cylinders 52, 54 and 56, the table 10 must be fully lowered so as to engage the actuator 82 to thereby permit the yoke 88 to be rotated by actuation of the handle 110. Of course, in order to lock each cylinder 52, 54 or 56 in place, the table 10 must also be lowered and the handle 110 rotated so as to rotate the yoke 88 associated with the respective cylinder to the horizontal position and thus to the lock position as illustrated in FIG. 3. Then when the table raises, actuator 82 locks the yoke 88 in position. When in the lock position, as illustrated in FIG. 3, the cylinders cannot be released unless and until the table 10 is fully lowered. This provides an enhanced safety factor. Also, when the table 10 is lowered, any combination of cylinders may be released or unlocked so as to counterbalance the weight on the table 10.

In operation, the peddle 38 releases the pinions 32 permitting the table 10 to move to its lowest position where peddle 38 is released to lock the table 10. The table 10 is then loaded with the work pieces and cylinders 52, 54, 56 are released to counterbalance the load as required. The peddle 38 is next released and the counterbalanced table 10 moved to the desired height. There peddle 38 is released and the pinions 32 locked so that work may commence. If desired, the counter balanced table 10 can then be easily moved by again releasing peddle 38 and resetting the level of the table 10.

Various other locking mechanisms which provide for locking or release of the cylinders 50 may be considered. The number of cylinders utilized may be increased or decreased. All of the cylinders may be constructed so as to be locked or unlocked. Thus, the invention is to be limited only by the following claims and equivalents thereof.

What is claimed is:

1. A counterbalance table comprising, in combination:

a table top;

a support stand including an upright member for mounting on a floor and a telescoping member slidably mounted in the upright member and connected to the table top;

at least two fluid cylinders for mounting on the support stand, each cylinder including a rod engageable with the table top for support thereof, one of said fluid cylinders providing a counterbalance force for supporting the table top, the other fluid cylinder positioned to support a work piece on the table top at least in part;

a lock mechanism for holding the other fluid cylinder from supporting the work piece, said lock mechanism being releasable only when the table top is at a lowest limit position.

2. The table of claim 1 including more than two fluid cylinders wherein all but one of the cylinders includes an associated lock mechanism.

3. The table of claim 1 wherein the upright member and telescoping member include a rack and pinion with a pinion locking mechanism for locking the telescoping members in a fixed position.

4. The table of claim 1 including a manual lever for movement of the lock mechanism between a position holding the fluid cylinder and a position releasing the fluid cylinder.

5. The table of claim 1 including first and second spaced, parallel upright members each having an associated telescoping member attached to and supporting the table top.

6. The table of claim 5 including at least two cylinders mounted parallel to and adjacent each uptight member.

7. The table of claim 1 including more than two cylinders.

8. The table of claim 1 including cylinders having a different load capacity.

9. A counterbalance table comprising, in combination:

a work table platform having an underside;

a table stand including a generally vertical, stationary support leg and a telescoping leg connected between the support leg and the table platform;

a first fluid cylinder mounted on the stand and including a fluid biased member connected to the table platform for counter balancing the weight of the table platform:

a second additional fluid cylinder mounted on the stand including a fluid biased member for engaging the underside of the table platform for counterbalancing a load on the table; and a lock out mechanism for engaging and locking the fluid biased member of the second fluid cylinder out of engagement with the table platform.

10. The counterbalance table of claim 9 wherein the lock out mechanism includes a pivotal plate for engaging the fluid biased member in a locked position, a cam member for engaging the pivotal plate and retaining the plate in the locked position, and a release mechanism responsive to movement of the table platform to a lowered position to release the cam member from the plate.

11. The counterbalance table of claim 5 including a plurality of additional fluid cylinders mounted on the stand, each fluid cylinder including a lock out mechanism.

12. The counterbalance table of claim 11 wherein each additional fluid cylinder has a distinct counterbalance force.

13. The counterbalance table of claim 12 wherein the counterbalance force of each additional fluid cylinder is the same.

14. The counterbalance table of claim 12 wherein the counterbalance force of each additional fluid cylinder is not the same.

15. The counterbalance table of claim 5 further including a table stand locking mechanism for locking and releasing the telescoping leg and the stationary leg.

16. The counterbalance table of claim 5 further including a mechanism for locking the telescope leg relative to the support leg and for releasing said mechanism for locking said telescoping leg relative to said support leg.

17. The counterbalance table of claim 5 wherein the table stand further includes a second support leg spaced from the stationary support leg and a second telescoping leg connected between the second support leg and the platform.

18. The counterbalance table of claim 5 wherein said stationary support leg and the connected telescoping leg includes a rack and pinion mechanism.

19. The counterbalance table of claim 18 further including a mechanism for locking movement of said pinion relative to said rack.

* * * * *